US010766122B2

(12) United States Patent
Lin

(10) Patent No.: US 10,766,122 B2
(45) Date of Patent: Sep. 8, 2020

(54) PRESSURE ADJUSTING DEVICE OF QUICK FIXTURE

(71) Applicants: Yi-Chen Tseng, Taichung (TW); HI-MAX INNOVATION CO., LTD., Taichung (TW)

(72) Inventor: Jhih-Fan Lin, Taichung (TW)

(73) Assignees: Hi-Max Innovation Co., Ltd., Taichung (TW); Yi-Chen Tseng, Taichung (TW)

( * ) Notice: Subject to any disclaimer, the term of this patent is extended or adjusted under 35 U.S.C. 154(b) by 267 days.

(21) Appl. No.: 15/973,021

(22) Filed: May 7, 2018

(65) Prior Publication Data

US 2019/0337126 A1 Nov. 7, 2019

(51) Int. Cl.
*B25B 11/00* (2006.01)
*B25B 27/02* (2006.01)

(52) U.S. Cl.
CPC ..... *B25B 11/00* (2013.01); *B25B 27/02* (2013.01)

(58) Field of Classification Search
CPC .... B25B 1/00; B25B 1/14; B25B 3/00; B25B 5/00; B25B 5/12; B25B 27/02; B25B 11/00
USPC ..... 29/244; 269/228, 201, 32
See application file for complete search history.

(56) References Cited

U.S. PATENT DOCUMENTS 2,502,804 A * 4/1950 Spencer ..... B25B 5/163 81/351
4,697,323 A * 10/1987 Sauvageau ..... B25B 13/48 29/264
5,513,836 A * 5/1996 Hillenburg ..... B25B 5/06 269/101

* cited by examiner

*Primary Examiner* — Lee D Wilson
*Assistant Examiner* — Khawaja H Samiullah
(74) *Attorney, Agent, or Firm* — Wang Law Firm, Inc.

(57) ABSTRACT

A pressure adjusting device of a quick fixture includes a main member, a fixed member fixed to the main member, a movable member movably connected to the main member, and an elastic member received in the main member and having opposite end connected to the fixed member and the movable member to urge the movable member. With the pressure adjusting device the quick fixture can fix various workpieces with different thicknesses.

7 Claims, 10 Drawing Sheets

PRESSURE ADJUSTING DEVICE OF QUICK FIXTURE

BACKGROUND OF THE INVENTION

1. Technical Field

The invention relates to a rapid fixture, and more particularly to a pressure adjusting device of a quick fixture.

2. Description of Related Art

In present days, various designs for decorations, furniture, and wood handicrafts are presented in the market. In the art of making wood handicrafts, a quick fixture is an important tool.

A conventional rapid fixture usually includes a base, on which a linkage mechanism, a handle, and a plunger are provided. The handle is connected to an input linkage of the linkage mechanism, and the plunger is connected to an output linkage of the linkage mechanism, so that the plunger is reciprocated via the linkage mechanism when a user levers thee handle to hold a workpiece (not shown).

In practice, various workpieces with different thicknesses are hold by the conventional rapid fixture. The plunger exerts a thick workpiece with a larger pressure than a thin workpiece. An improved quick fixture provides a pressure adjustor to adjust the pressure of the plunger exerting the workpiece. However, the pressure adjustor is complex, and it has to be operated by user.

BRIEF SUMMARY OF THE INVENTION

In view of the above, the primary objective of the present invention is to provide a pressure adjusting device of a quick fixture, which automatically adjusts a pressure on a workpiece according to a thickness of the workpiece.

In order to achieve the objective of the present invention, a pressure adjusting device of a quick fixture includes a main member having a first opening and a second opening at opposite ends thereof; a fixed member fixed to the main member through the second opening; a movable member movably connected to the main member through the first opening, wherein the movable member has a first stop block received in the main member, and the first stop block is larger than the first opening of the main member; and an elastic member received in the main member and having opposite end connected to the fixed member and the movable member to urge the movable member.

In an embodiment, the main member has a first plug connected to an end thereof, and the first plug is provided with the first opening.

In an embodiment, the main member has a second plug connected to an end thereof, and the second plug is provided with the second opening; the second opening is a threaded hole, and the fixed member has a threaded section to be threaded with the second opening.

In an embodiment, the main member has an inner threaded section on an interior side thereof, and fixed member has a first outer threaded section threaded with the inner threaded section of the main member.

In an embodiment, the pressure adjusting device further includes an auxiliary holder fixing the fixed member to the main member.

In an embodiment, the fixed member has a threaded section, and the auxiliary holder is a nut threaded onto the fixed member and abutted against the main member.

In an embodiment, the pressure adjusting device further includes a plunger connected to the movable member.

In an embodiment, the pressure adjusting device further includes a plunger connected to the fixed member.

In an embodiment, the movable member is provided with a first connector, and the fixed member is provided with a second connector; both the first connector and the second connector are received in the main member to be connected to the opposite ends of the elastic member.

In an embodiment, the elastic member is a compression spring urging the movable member to have the first stop block against the main member in a normal condition.

In an embodiment, the elastic member is a tension spring with opposite ends hooked to a first bore on the first connector of the movable member and a second bore on the second connector of the fixed member.

As a result, the present invention may make the quick fixture fix various workpieces with different thicknesses.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
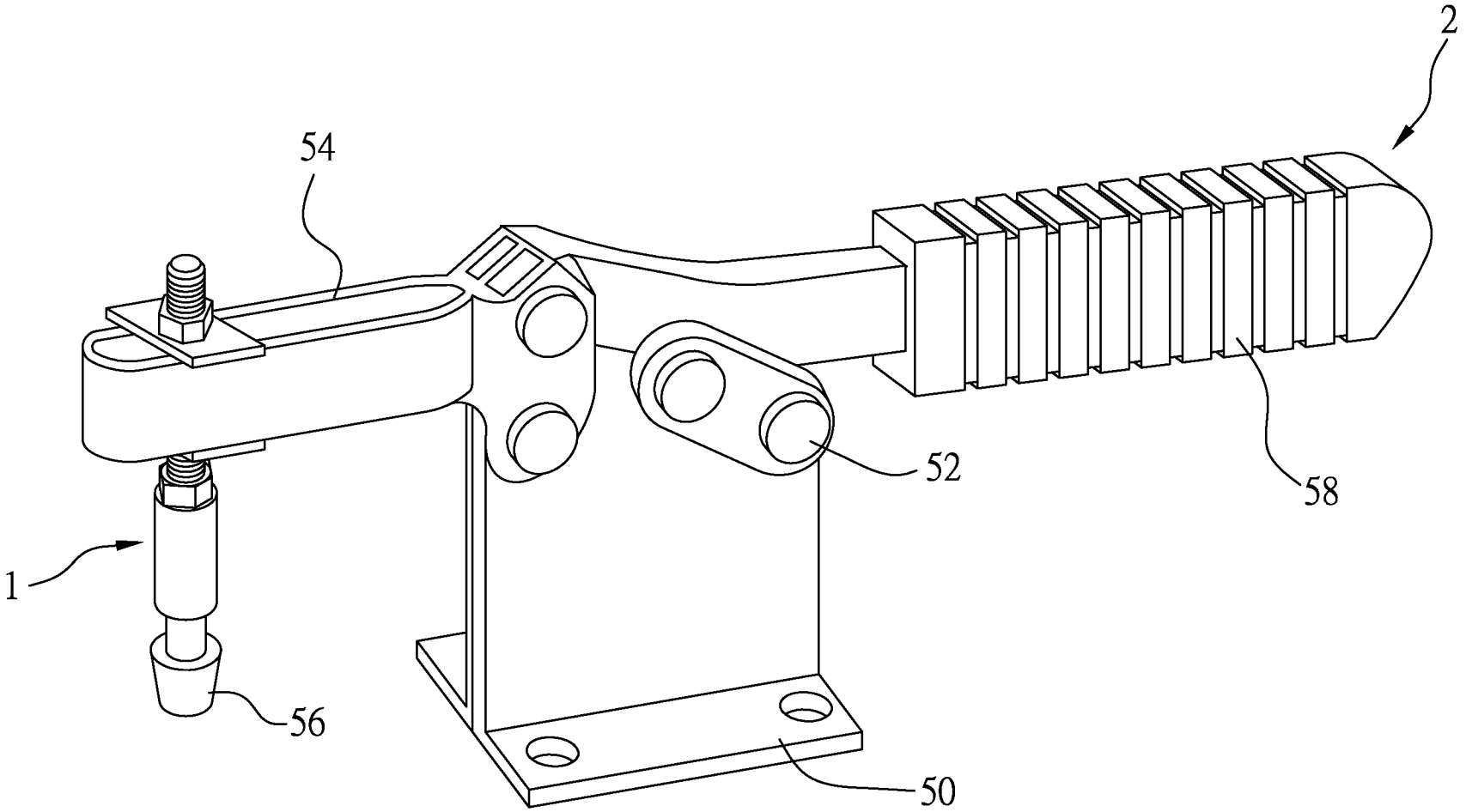
FIG. 1 is a perspective view of the quick fixture of a first preferred embodiment of the present invention.

FIG. 1 shows a vertical type quick fixture 2 of the first preferred embodiment of the present invention, which includes a base 50, a linkage 52, an output bar 54, a plunger 56, a handle 58, and a pressure adjusting device 1. The linkage 52 is pivoted on the base 50 and the handle 58, and the output bar 54 is pivoted on the base 50 and the handle 58 to form a four-link mechanism. The pressure adjusting device 1 is movably connected to the output bar 54, and the plunger 56 is connected to the pressure adjusting device 1.

Figure 2:
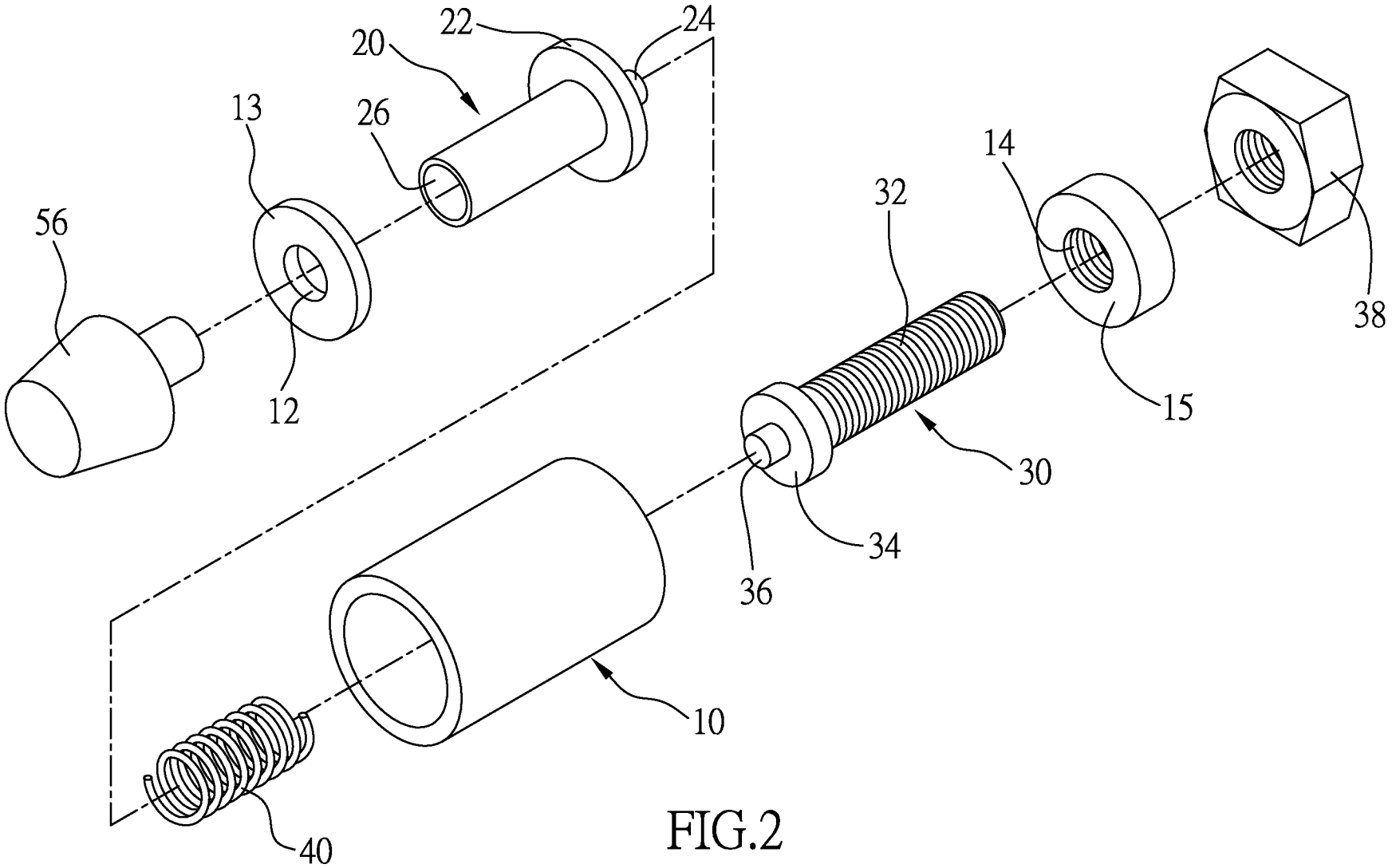
FIG. 2 is an exploded view of the first preferred embodiment of the present invention.
Figure 3:
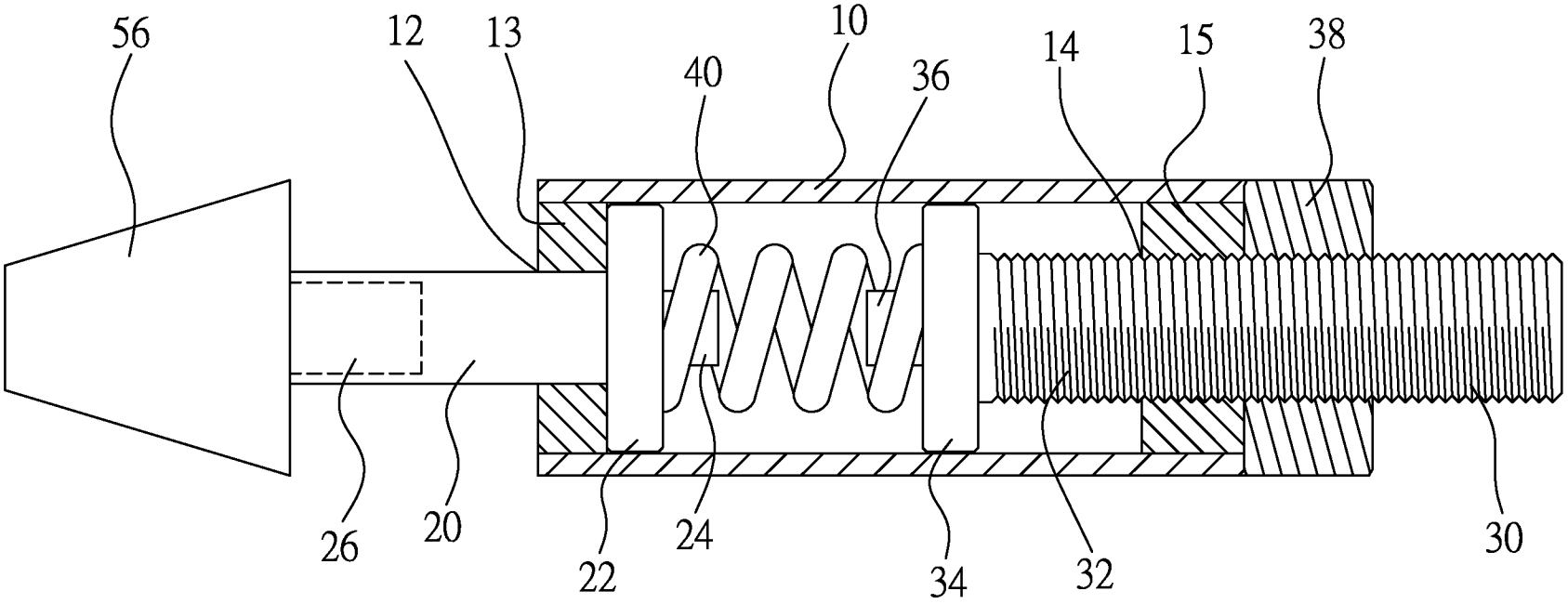
FIG. 3 is a sectional view of the first preferred embodiment of the present invention.
Figure 5:
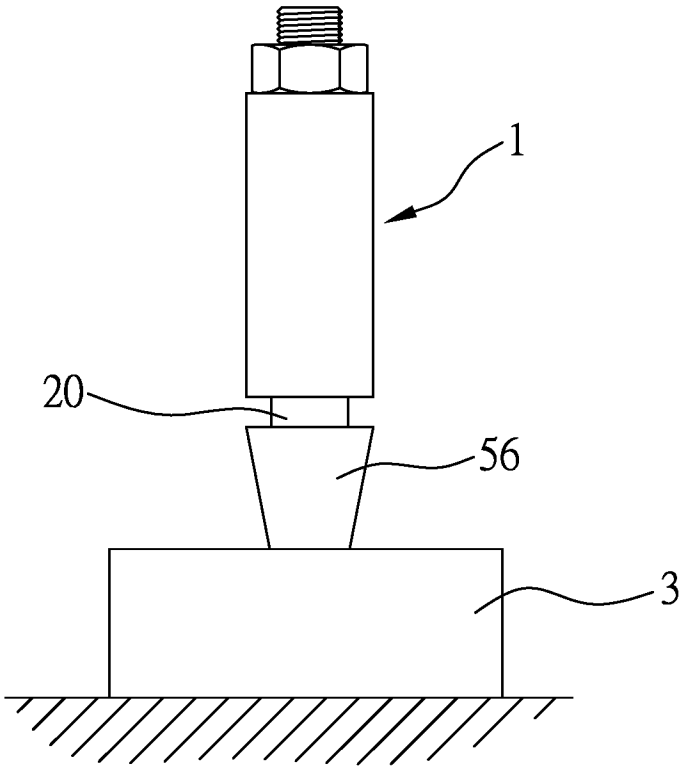
FIG. 5 is a sketch diagram of the first preferred embodiment of the present invention, showing a thick workpiece being held.

As shown in FIG. 2 and FIG. 3, the pressure adjusting device 1 of the first preferred embodiment of the present invention includes a main member 10, a movable member 20, a fixed member 30, and an elastic member 40.

The main member 10 is a barrel-like member, having a first opening 12 and a second opening 14 at opposite ends thereof. In the first preferred embodiment, the main member 10 has a first plug 13 inserted into the end of the main member 10, and the first plug 13 is provided with the first opening 12. The main member 10 further has a second plug 15 inserted into the other end of the main member 10, and the second plug 15 is provided with the second opening 14. The second opening 14 is a threaded hole.

The movable member 20 is movably received in the main member 10. In the first preferred embodiment, the movable member 20 has a first stop block 22 which is larger than the first opening 12. The movable member 20 has an end extending out of the main member 10 through the first opening 12, and the first stop block 22 still is received in the main member 10 and restricted by the first plug 13. The movable member 20 further has a first connector 24 on a back of the first stop block 22. The movable member 20 has a connecting portion 26 at an end extending out of the main member 10, and the connecting portion 26 is a slot to engage the plunger 56.

The fixed member 30 is fixed to the main member 10. In the first preferred embodiment, the fixed member 30 has a threaded section 32 and a second stop block 34 at an end thereof. The fixed member 30 has an end extending out of the main member 10 through the second opening 14, and the second stop block 34 still is received in the main member 10 and restricted by the second plug 15. It is noted that the threaded section 32 of the threaded section 32 of the fixed member 30 is threaded with the second opening 14 of the threaded hole, so that the fixed member 30 is fixed to the main member 10 and can be shifted by turning the fixed member 30. The fixed member 30 is connected to the output bar 54 with the end out of the main member 10. The fixed member 30 further has a second connector 36 at a back of the second stop block 34 and facing the first connector 24.

The elastic member 40 is a compression spring in the first preferred embodiment. The elastic member 40 is received in the main member 10, and has opposite ends engaging the first connector 24 and the second connector 36. The elastic member 40 urges the movable member 20 to make the first stop block 22 against the first plug 13 in a normal condition.

The pressure adjusting device 1 of the first preferred embodiment further has an auxiliary holder 38 to fix the fixed member 30 to the main member 10. The auxiliary holder 38 is a nut in the first preferred embodiment to be threaded onto the fixed member 30 and abutted against the main member 10 or the second stop block 15.

Figure 4:
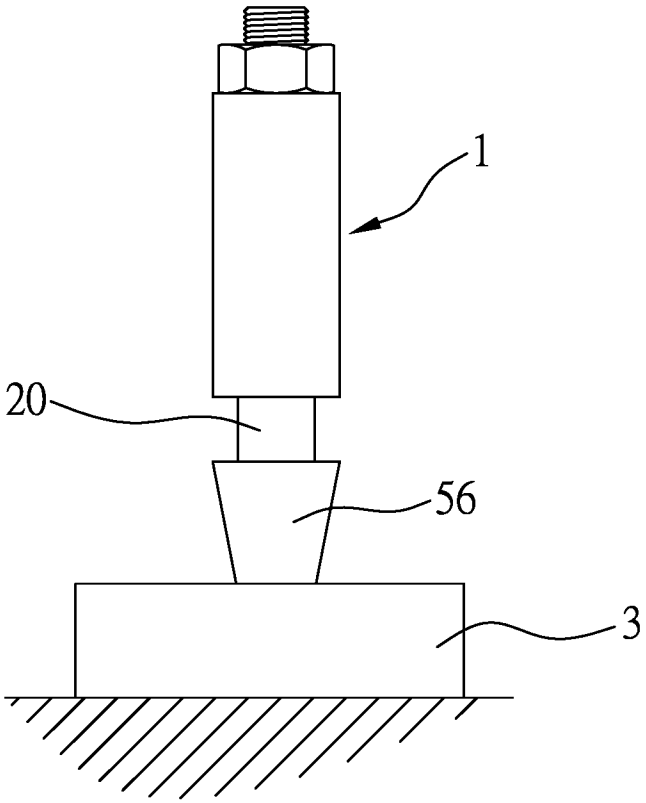
FIG. 4 is a sketch diagram of the first preferred embodiment of the present invention, showing a thin workpiece being held.

When a user levers the handle 58 to move the pressure adjusting device 1 and the plunger 56 toward a workpiece 3, the elastic member 40 will be compressed for a specified deflection according to a thickness of the workpiece 3. For example, the deflection of the elastic member 40 is small when a thin workpiece 3 is fixed, as shown in FIG. 4, and the deflection of the elastic member 40 is large when a thick workpiece 3 is fixed.

In conclusion, the elastic member 40 will be compressed for a specified deflection according to a thickness of the workpiece 3 so that the quick fixture 2 with the pressure adjusting device 1 can fix the workpieces with different thicknesses.

Figure 6:
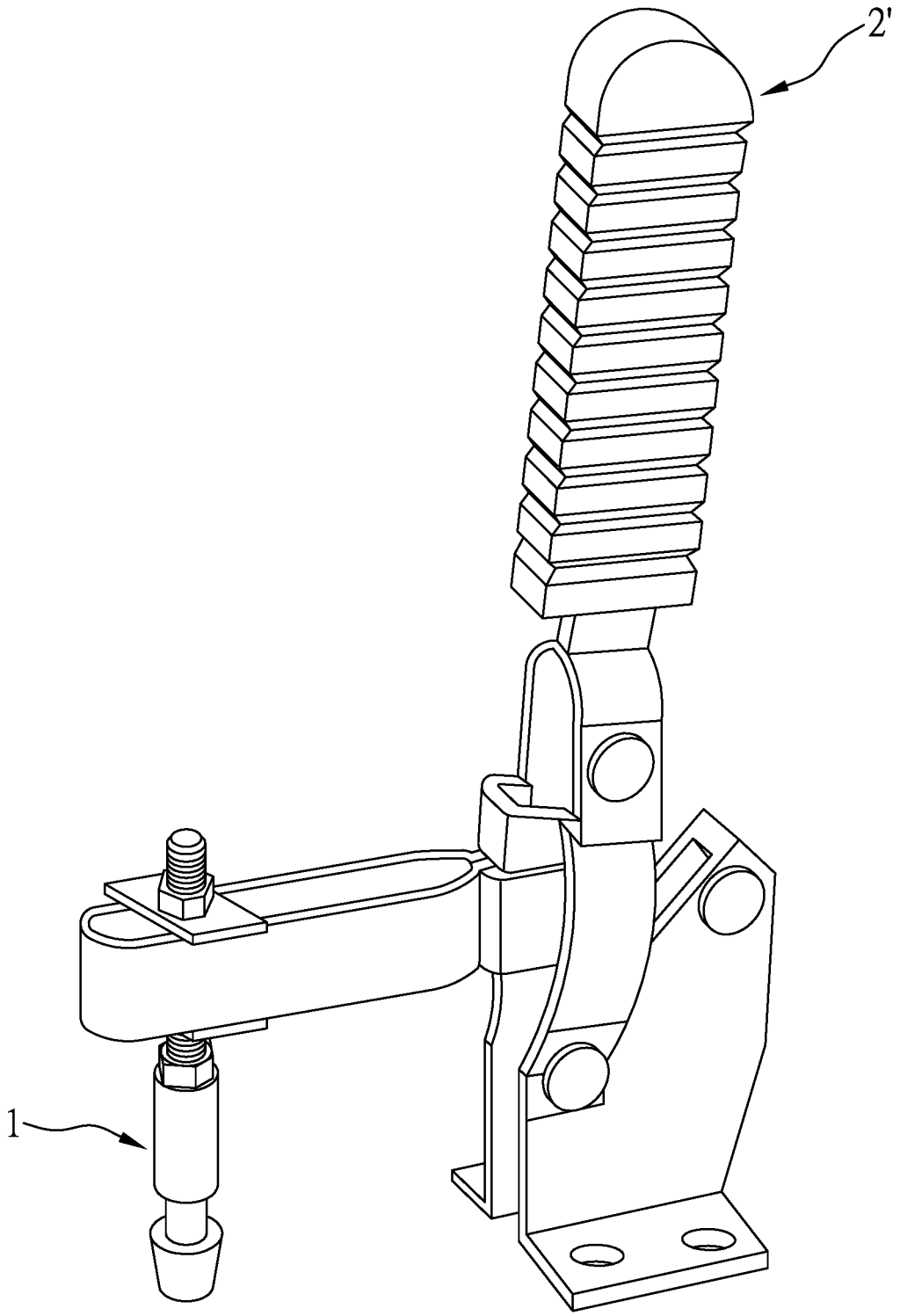
FIG. 6 is a perspective view of the quick fixture of a second preferred embodiment of the present invention.
Figure 7:
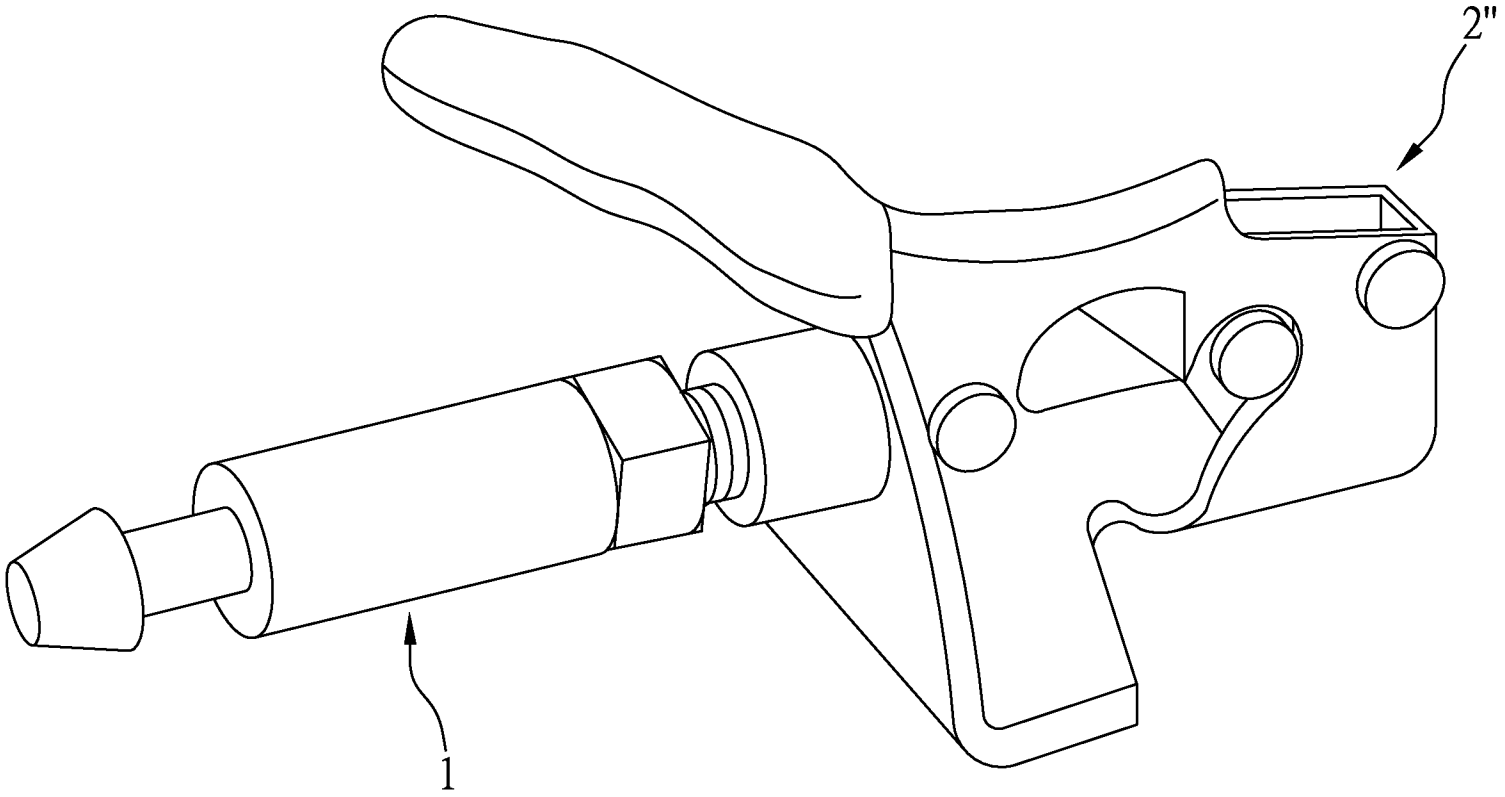
FIG. 7 is a perspective view of the quick fixture of a third preferred embodiment of the present invention.

It is easy to understand that the pressure adjusting device 1 can be applied to different types of quick fixtures. For example, FIG. 6 shows a horizontal type quick fixture 2' with the pressure adjusting device 1, and FIG. 7 shows a push-pull type quick fixture 2" with the pressure adjusting device 1. The functions and operations of the quick fixtures 2' and 2" are the same.

Figure 8:
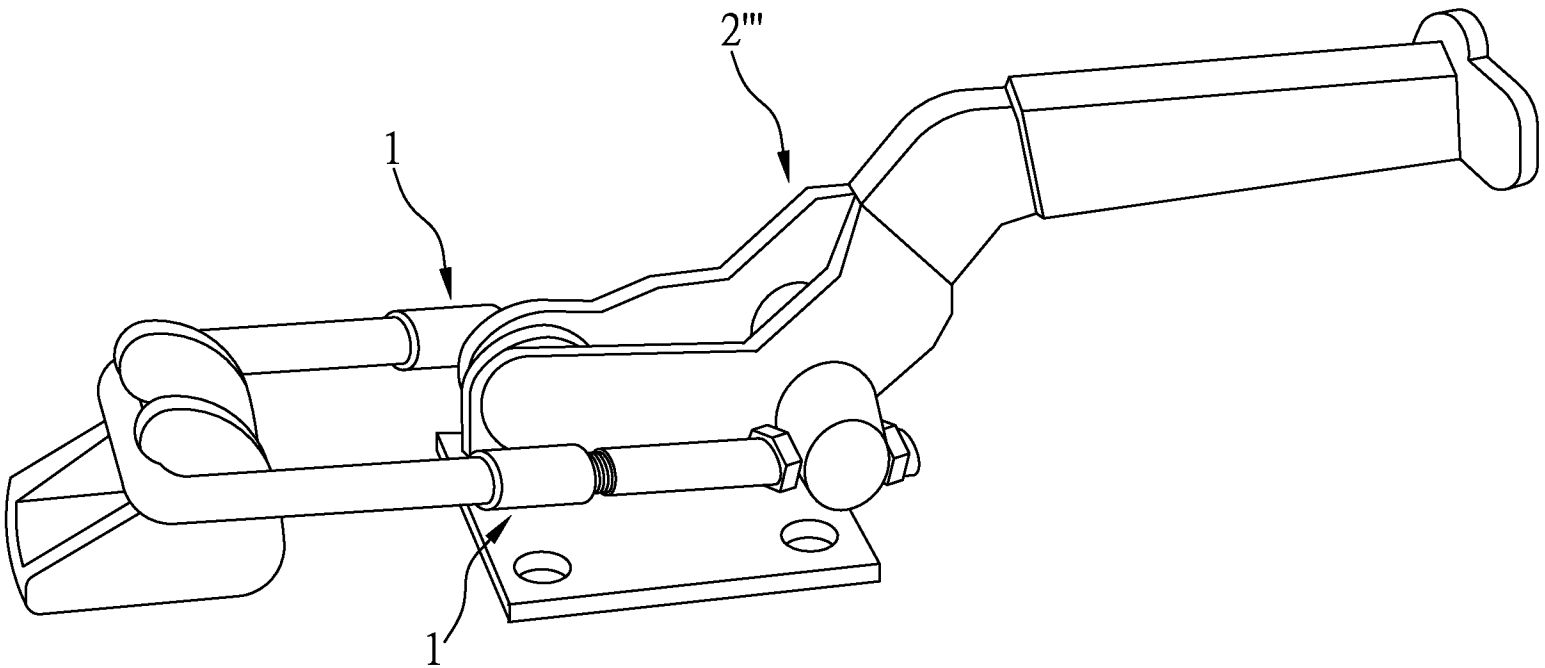
FIG. 8 is a perspective view of the quick fixture of a fourth preferred embodiment of the present invention.
Figure 9:
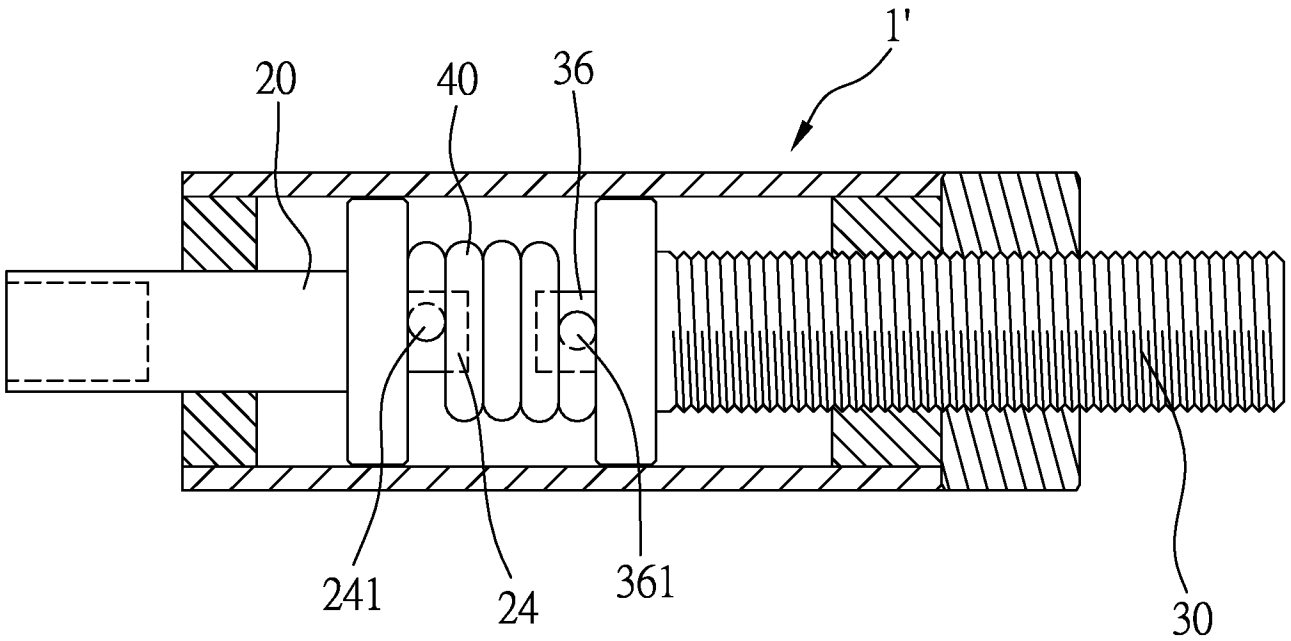
FIG. 9 is a sectional view of the fourth preferred embodiment of the present invention, showing the elastic member in the normal condition.
Figure 10:
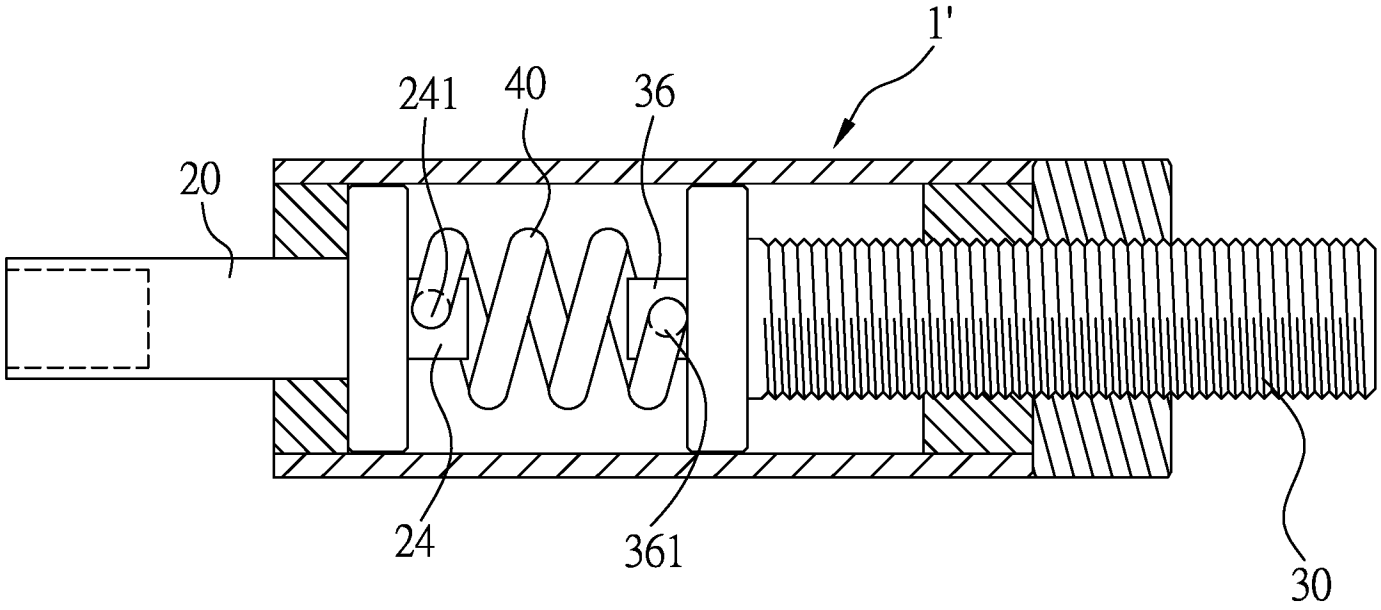
FIG. 10 is a sectional view of the fourth preferred embodiment of the present invention, showing the elastic member being extended.

FIG. 8 shows a latch type quick fixture 2'" with a pressure adjusting device 1' of the fourth preferred embodiment. FIG. 9 and FIG. 10 show a detail of the pressure adjusting device 1' of the fourth preferred embodiment, which is the same as the pressure adjusting device 1 of the first preferred embodiment, except that the elastic member 40 is a tension spring with opposite ends hooked to a first bore 241 on the first connector 24 of the movable member 20 and a second bore 361 on the second connector 36 of the fixed member 30.

The elastic member 40 draws the movable member 20 in the main member 10 in a normal condition, and can be pulled out when the handle 58 is levered to adjust the plunger 56 according to a thickness of a workpiece to be fixed.

Figure 11:
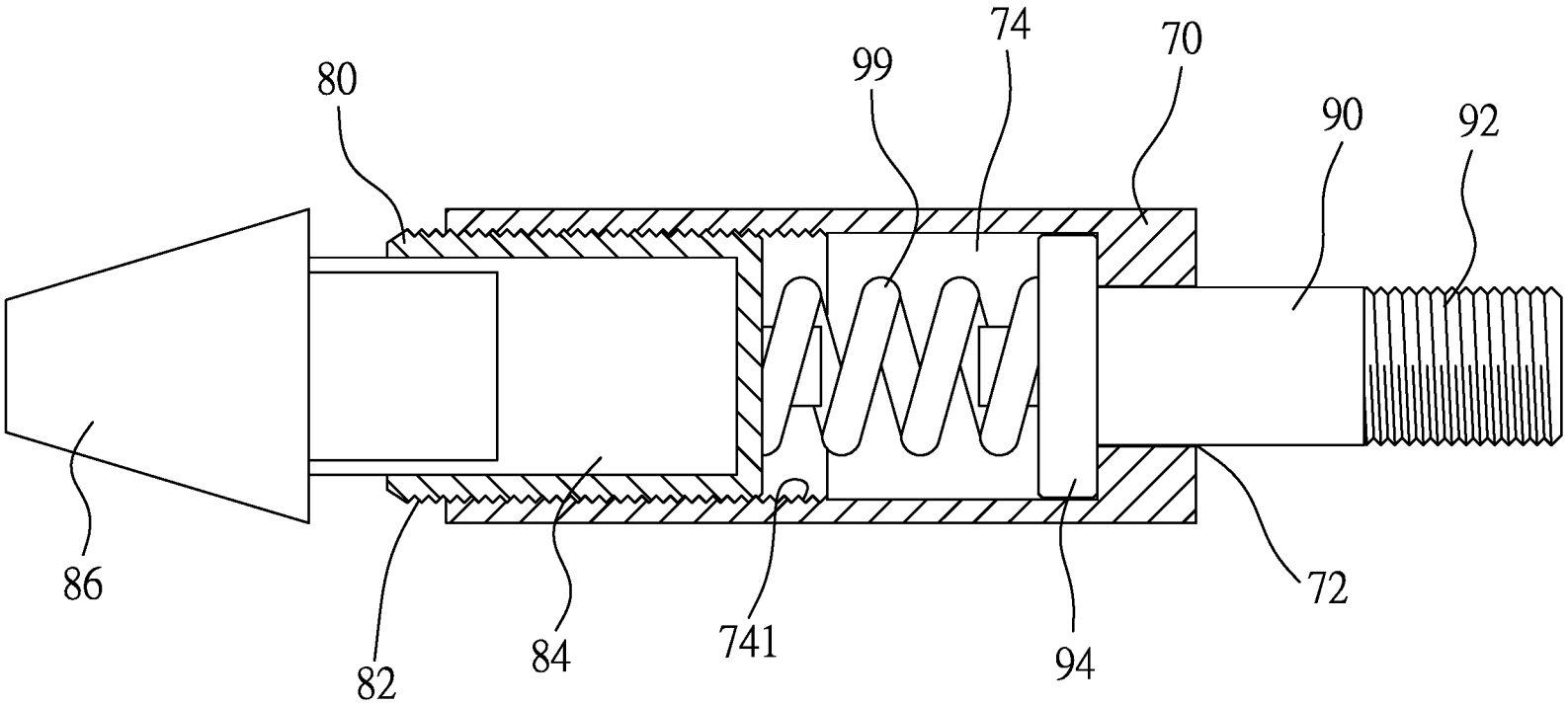
FIG. 11 is a sectional view of the fifth preferred embodiment of the present invention.

As shown in FIG. 11, a pressure adjusting device 1" of the fifth preferred embodiment includes a main member 70, a fixed member 80, a movable member 90, and an elastic member 99. The main member 70 has a first opening 72 and a second opening 74 at opposite end, and an inner threaded section 741 on an interior side of the main member 70. The first opening 72 is smaller than second opening 74.

The fixed member 80 is a barrel-like member having a first outer threaded section 82 on an exterior side thereof. The fixed member 80 is fixed to the main member 70 by meshing the first outer threaded section 82 with the inner threaded section 741 through the second opening 74. The fixed member 80 has a connecting portion at an end out of the main member 70 to connect a plunger 84.

The movable member 90 has a second outer threaded section 92 and a stop block 94 at opposite ends thereof. The stop block 94 is larger than the first opening 72. The end with the second outer threaded section 92 of the movable member 90 extends out of the main member 70 through the first opening 72to connect an output bar of a quick fixture (not shown), and the stop block 94 is received and restricted in the main member 70.

The elastic member 99 has opposite end urging the fixed member 80 and the movable member 90, so that the elastic member 99 will be compressed by the movable member 90 with a specified deflection according to a thickness of s workpiece to be fixed. The functions and operations of the pressure adjusting device 1" of the fifth preferred embodiment are the same as above, and the pressure adjusting device 1" of the fifth preferred embodiment is able to be incorporated in any type of the quick fixtures as described above.

It must be pointed out that the embodiments described above are only some preferred embodiments of the present invention. All equivalent structures which employ the concepts disclosed in this specification and the appended claims should fall within the scope of the present invention.

What is claimed is:

1. A pressure adjusting device of a quick fixture, comprising:

a main member having a first end and a second end at opposite ends thereof; each ends having an opening;

a fixed member fixed to the main member through the second end;

a movable member movably connected to the main member through the first end, wherein the movable member has a first stop block received in the main member, an elastic member received in the main member and having opposite end connected to the fixed member and the movable member to urge the movable member;

wherein the main member has a first plug connected to the first end of the main member; the first plug is provided with a first opening, and the first stop block is larger than the first opening;

wherein the main member has a second plug connected to the second end of the main member; the second plug is provided with a second opening, and the second opening comprises a threaded hole, and the fixed member has a threaded section to be threaded with the second opening; and an auxiliary holder located at the second end of the main member, wherein the auxiliary holder comprises a nut;

wherein the fixed member has a threaded section to be threaded with both the threaded hole of the second plug and the nut of the auxiliary holder in sequence, and the nut abuts against the second plug.

2. The pressure adjusting device of the quick fixture of claim 1, wherein the main member has an inner threaded section on an interior side thereof, and fixed member has a first outer threaded section threaded with the inner threaded section of the main member.

3. The pressure adjusting device of the quick fixture of claim 1, further comprising a plunger connected to the movable member.

4. The pressure adjusting device of the quick fixture of claim 1, further comprising a plunger connected to the fixed member.

5. The pressure adjusting device of the quick fixture of claim 1, wherein the movable member is provided with a first connector, and the fixed member is provided with a second connector; both the first connector and the second connector are received in the main member to be connected to the opposite ends of the elastic member respectively.

6. The pressure adjusting device of the quick fixture of claim 5, wherein the elastic member is a compression spring urging the movable member to have the first stop block against the main member.

7. The pressure adjusting device of the quick fixture of claim 5, wherein the elastic member is a tension spring with opposite ends hooked to a first bore on the first connector of the movable member and a second bore on the second connector of the fixed member.

* * * * *